US008978674B2

(12) United States Patent
Büsing et al.

(10) Patent No.: US 8,978,674 B2
(45) **Date of Patent: *Mar. 17, 2015**

(54) WATER-BEARING DOMESTIC APPLIANCE WITH A WATER DIVERTER

(75) Inventors: Johannes Büsing, Emersacker (DE); Anton Oblinger, Wertingen (DE); Pedro Sancho, Zaragoza (ES); David Semerad, Holzheim (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 814 days.

This patent is subject to a terminal disclaimer.

(21) Appl. No.: 12/743,242

(22) PCT Filed: Oct. 28, 2008

(86) PCT No.: PCT/EP2008/064589

§ 371 (c)(1),
(2), (4) Date: May 17, 2010

(87) PCT Pub. No.: WO2009/068394

PCT Pub. Date: Jun. 4, 2009

(65) Prior Publication Data

US 2011/0114139 A1 May 19, 2011

(30) Foreign Application Priority Data

Nov. 27, 2007 (DE) ..... 10 2007 056 922

(51) Int. Cl.
*A47L 15/42* (2006.01)
*D06F 39/08* (2006.01)

(52) U.S. Cl.
CPC ..... *D06F 39/088* (2013.01); *A47L 15/4221* (2013.01)
USPC ..... 134/191; 134/56 D

(58) Field of Classification Search
USPC ..... 134/191
See application file for complete search history.

(56) References Cited

U.S. PATENT DOCUMENTS

| | | | | |
|---|---|---|---|---|
| 3,807,444 | A | 4/1974 | Fortune | |
| 4,452,277 | A | 6/1984 | Wells | |
| 5,331,986 | A | 7/1994 | Lim et al. | |
| 2004/0173249 | A1 | 9/2004 | Assmann et al. | |
| 2004/0226586 | A1 * | 11/2004 | Ertle et al. | 134/57 D |
| 2005/0022849 | A1 | 2/2005 | Park et al. | |
| 2010/0078049 | A1 | 4/2010 | Assmann et al. | |

FOREIGN PATENT DOCUMENTS

| | | |
|---|---|---|
| DE | 1610146 | 11/1970 |
| DE | 2910429 A1 | 10/1979 |

(Continued)

*Primary Examiner* — Michael Barr
*Assistant Examiner* — Jason Riggleman
(74) *Attorney, Agent, or Firm* — James E. Howard; Andre Pallapies

(57) ABSTRACT

A water-bearing domestic appliance, in particular a dishwasher or washing machine, having a water diverter which is formed by an adjustable fluid distributor body provided with one or more passage openings. In an exemplary embodiment of the invention, respective passage openings connect a respective water supply path to a respective water discharge path in such a way that the direction of flow of water into and out of the passage openings is established in essentially the same direction of flow of water.

14 Claims, 4 Drawing Sheets

(56) References Cited

FOREIGN PATENT DOCUMENTS

| | | | | | |
|---|---|---|---|---|---|
| DE | 8816597 | U1 | | 2/1990 | |
| DE | 4418153 | A1 | | 11/1995 | |
| DE | 19918337 | A1 | | 10/2000 | |
| EP | 0383028 | A2 | * | 1/1990 | ..... A47L 15/42 |
| GB | 1532884 | | * | 11/1978 | ..... A47L 15/42 |
| GB | 2016627 | A | | 9/1979 | |

* cited by examiner

WATER-BEARING DOMESTIC APPLIANCE WITH A WATER DIVERTER

BACKGROUND OF THE INVENTION

Water diverters are used in water-bearing domestic appliances, such as washing machines or dishwashers for example, to control flows of liquid in the water-bearing domestic appliance. When used in a washing machine water diverters serve to dispense washing or rinsing water for example to a first or second detergent compartment of two detergent compartments. When used in dishwashers water diverters serve to dispense washing water, also referred to as washing liquor, for example alternately to a spray arm for an upper rack or to a spray arm for a lower rack of the respective dishwasher or simultaneously to both spray arms.

In the case of a known water diverter (DE 16 10 146 B2) a rotatable control slider is provided in a cylindrical housing, connecting a supply channel to one of a number of discharge channels by means of a swivel tube. The swivel tube here has a rotating pin, which is disposed in a socket of the supply channel in the manner of a ball and socket joint. A sealing element in the manner of a hollow cylinder is secured to the mouth of the swivel tube opposite the discharge channels and slides in a cylindrical guide running concentrically to the outer surface of the housing. However such a mechanical sealing apparatus is only suitable for a seal in a cylindrical housing. The known mechanical sealing apparatus in question is not suitable for sealing passage openings through a flat rotating disk in respect of fluid discharge lines opposite said flat rotating disk. Also this known water diverter can produce an unwanted pressure loss in the water flow to be distributed in each instance due to its deflection by means of the swivel tube.

Another known water diverter (DE 101 33 130 A1) consists of a rotating slider disposed in the pressure chamber of a circulating pump before branching pressure connections to block and release the pressure connections for washing liquid and a drive for the rotating slider outside and inside the pressure chamber. The rotating slider in question is formed by a cylindrical component, in the cylindrical wall of which one or more apertures are located between one and a number of movable closing elements with a valve function. The apertures and the closing elements are configured in their relative position to the pressure connections, which form the water supply and/or water discharge connections, such that depending on the rotation of the rotating slider, the pressure connections opposite its cylinder wall are released or blocked in a sealing manner. However this known sealing apparatus is thus also only suitable for sealing openings provided in a cylinder wall. The known mechanical sealing apparatus in question is not suitable for sealing passage openings through a flat rotating disk in respect of fluid discharge lines opposite said flat rotating disk. And this known water diverter also produces an unwanted pressure loss in the water flow to be distributed in each instance due to its deflection in the abovementioned rotating slider.

An expansion connection apparatus for a pipe carrying a fluid medium under pressure and at a high temperature, in particular for a pipe connecting the exhaust of a vehicle to a turbocharger serving to compress the fuel mixture, is already known (DE 29 10 429 A1; GB 2 016 627 A). With this known expansion connection apparatus an outer pipe element and an inner pipe element that can be pushed into it in a telescopic manner are provided; a sealing apparatus is also disposed between the end of the outer pipe element and the peripheral surface of the inner pipe element and an apparatus producing a Venturi effect is also secured to the telescopic end of the inner pipe element, serving to reduce the pressure and temperature of the fluid medium at the sealing apparatus. This known expansion connection apparatus allows exhaust gases to be prevented in a leakage path when a combustion engine is started up, in that both the pressure and the temperature of the fluid medium can be reduced at the sealing or damping apparatus by utilizing the abovementioned Venturi effect, being disposed between the abovementioned telescopic pipe elements. Whether and optionally how this known sealing measure could be used to seal a transition region between a rotatable fluid distribution element, to which a fluid to be discharged to one or more fluid discharge lines can be supplied from a fluid supply line, cannot however be derived from the known expansion connection apparatus.

BRIEF SUMMARY OF THE INVENTION

The object of the invention is therefore to provide a water-bearing domestic appliance, in particular a dishwasher or washing machine, with a water diverter with reduced pressure loss.

The invention is based on a water-bearing domestic appliance, in particular a dishwasher or washing machine, at least having a water diverter, which is formed by an adjustable fluid distribution element provided with one or more passage openings.

The inventive solution is characterized in that the respective passage openings connect a water supply path to a respective water discharge path in such a manner that the water flow direction into and out of the passage openings is established in essentially the same water flow direction.

The fluid distribution element here can be configured as an adjustable, in particular displaceable plate, having a basic rectangular form for example. However provision is preferably made for the fluid distribution element to be configured as a rotating disk. Provision is also preferably made for the water flow direction into and out of the passage openings to be established in essentially the axial direction of the rotating disk.

This has the advantage that the passage of water through the water diverter according to the invention experiences a smaller pressure loss than with the known water diverters considered in the introduction. With the water diverters according to the invention the pressure loss in question is for example 20 mbar and therefore significantly lower than the pressure loss with the known water diverters considered in the introduction. This has the further advantage that the present invention means that a lower delivery rate is sufficient for the water to be dispensed by the water diverter and it is therefore possible to use a less powerful pump motor to drive a water pump providing the water in question than with the known water diverters considered in the introduction.

By configuring the passage openings on the side of the rotating disk facing the water supply path with intake regions extended in a funnel shape, the present invention also makes it possible in a relatively simple manner to configure the respective passage openings in the rotating disk as Venturi openings so that the pressure of the water flowing through the transition region between the outlet side of the respective passage opening and the inlet region into the respective water discharge path in each instance is lower than the pressure in the region surrounding the relevant transition region. This means that there is no need for additional mechanical sealing apparatuses in the abovementioned transition region.

An extension element connected to the water supply path and lying adjacent to the peripheral region of the rotating disk is preferably provided on the side of the passage openings facing the water supply path. This allows different numbers of the passage openings in said rotating disk to be supplied with water from the water supply path in a relatively simple manner and thus makes it possible to route said water to corresponding fluid discharge paths with little pressure loss and utilizing the abovementioned sealing action by means of the Venturi effect.

The abovementioned extension element is expediently configured with an oval shape running in the region of the peripheral direction of the rotating disk. This has the advantage of a particularly simple embodiment option for the passage openings in said rotating disk In a further expedient embodiment of the water diverter according to the present invention the passage openings in the rotating disk each have intake regions that are located and formed in such a manner in relation to the water supply path and the water discharge paths that a set number of water discharge paths are connected to the water supply path for a passage of water in each instance in different rotation positions of the rotating disk. This has the advantage that the rotating disk can be configured in such a manner in respect of the passage openings embodied respectively for a small pressure loss in the water diverter and utilizing the Venturi effect that a discharge of water from the water supply path to a respectively set number of water discharge paths is made possible by the respectively predetermined number of passage openings.

The water diverter according to the present invention is contained in a domestic appliance, in particular in a dishwasher. Such a domestic appliance thus has the advantages set out above in relation to the water diverter according to the invention.

BRIEF DESCRIPTION OF THE DRAWINGS

The invention is described in more detail below based on an exemplary embodiment with reference to drawings, in which.

DETAILED DESCRIPTION OF EXEMPLARY EMBODIMENTS OF THE PRESENT INVENTION

Figure 1:
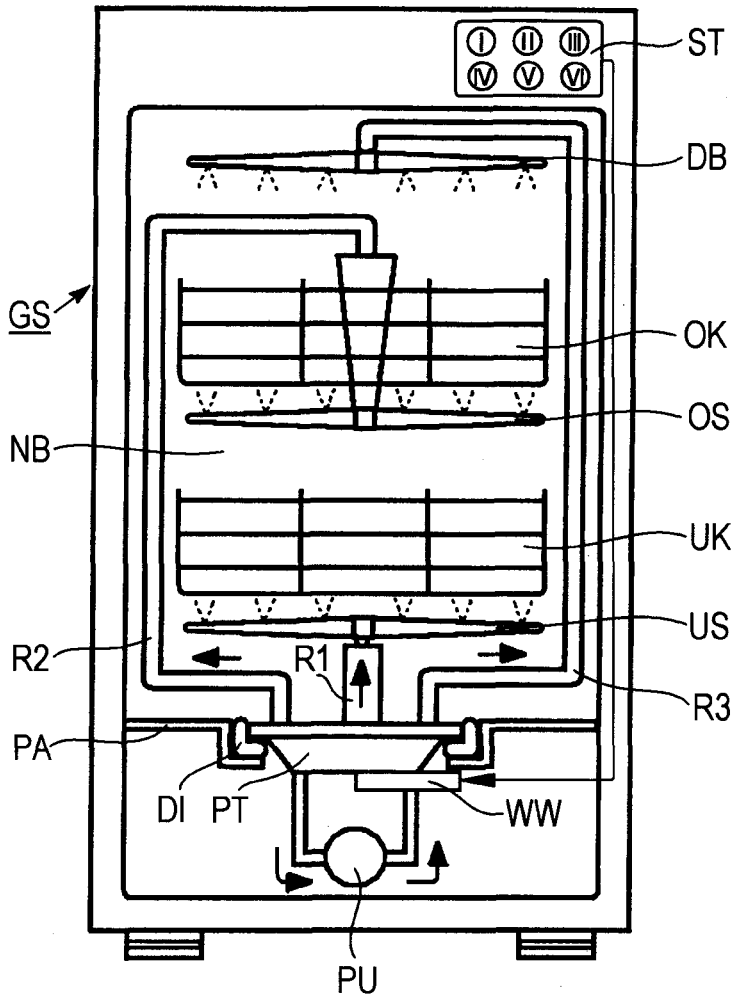
FIG. 1 shows a schematic diagram of a dishwasher, in which the present invention is used.

Before examining the drawings in more detail, it should be noted that identical elements and facilities are shown with the same reference characters in all the figures.

The schematic diagram in FIG. 1 shows a dishwasher GS with sufficient detail for an understanding of the present invention. The dishwasher GS contains a preferably closeable wash container, which has a wet region NB according to FIG. 1. In this wet region NB is at least one rack—in the present instance in fact two racks are provided, namely a lower rack UK and an upper rack OK disposed above it. A lower spray arm US is disposed below the lower rack UK, allowing washing liquor to be dispensed from its upper face onto the lower rack UK and items to be washed that may be contained therein—as shown by spray jets. While dispensing this washing liquor the lower spray arm US rotates in the known manner due to the water pressure of the washing liquor dispensed by it. An upper spray arm OS is disposed above the lower rack UK and like the lower spray arm US allows washing liquor to be dispensed from its upper face onto the upper rack OK and items to be washed that may be contained therein—as also shown by spray jets. This upper spray arm OS also rotates due to the water pressure of the washing liquor dispensed by it.

In the topmost region of the wet region NB of the dishwasher GS according to FIG. 1 there is also what is known as a top spray DB, which can be formed for example by a rotatable spray arm, which is able to dispense washing liquor from its lower face in the direction of the upper rack OK and therefore also the lower rack UK, as shown by spray jets in FIG. 1.

The washing liquor for the lower spray arm US, the upper spray arm OS and the top spray DB is supplied by pipes R1, R2 and R3 from a sump PT located in the lower part of the dishwasher GS. The sump PT, which is preferably configured as circular in its upper region and held by a correspondingly formed receiving opening of a sump holder PA, represents a pump apparatus for providing the abovementioned washing liquor, as will become clearer below. This washing liquor is first supplied by water from a water supply line (not shown) connected to the dishwasher GS and once a set quantity of water has been taken in by using the washing water dispensed by means of the washing liquor.

As shown in FIG. 1, a sealing ring D1 is disposed between the sump holder PA and the sump PT inserted therein to ensure that the region of the dishwasher GS below the sump holder PA is sealed off from the wet region NB. This means that no water can penetrate into this region of the dishwasher GS, which to an extent represents a dry region. It should also be noted here with regard to the pipes R2 and R3 that in an actual configuration of the dishwasher GS these can be provided on or in the rear wall of the wash container.

As shown in FIG. 1, a circulating pump PU is connected to the abovementioned sump PT, taking in washing water supplied to the dishwasher GS by the abovementioned water supply line or washing water from the washing liquor collected by the sump PT from the wet region NB and dispensing it under pressure to the abovementioned pipes R1, R2 and R3. In FIG. 1 a water diverter WW is also disposed on the sump PT—in other words outside the wet region NB—being integrated in or with the sump PT to some degree. This water diverter WW can be controlled into different positions by a control facility ST provided in the upper part of the dishwasher GS shown in FIG. 1 so that washing water or washing liquor can be dispensed in a respectively specified manner to the abovementioned pipes R1, R2 and R3. This is examined in more detail below. The abovementioned control facility ST is shown in FIG. 1 as a control facility having for example six program buttons I, II, III, IV, V and VI, which when its program buttons I to VI are actuated allows the water diverter WW to be set in one of six different setting positions respectively. This is also examined in more detail below. It should also be noted here that the control facility can be formed by a microcontroller with its own software or by a microcomputer system, having a central unit or CPU, a ROM program memory, a RAM main memory and interface circuits such as UART or USART circuits, which act as interface circuits between the program buttons I to VI and the water diverter motor WM on the one hand and the central unit or CPU on the other hand.

Figure 2:
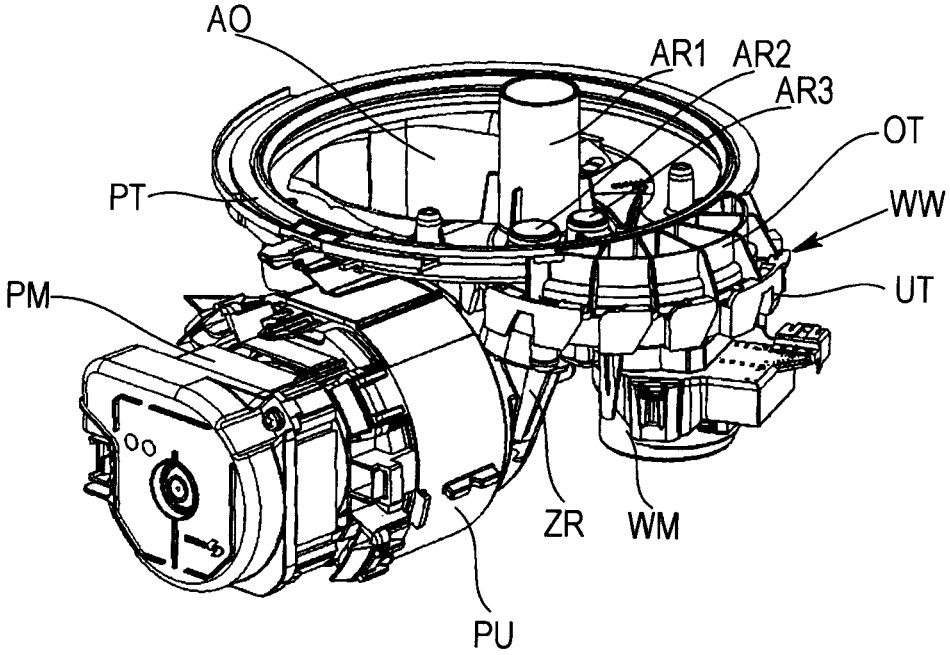
FIG. 2 shows a perspective view (not to scale) of a sump apparatus embodied according to the invention, as can be used in the dishwasher according to FIG. 1.

We will now look more closely at the perspective view of the sump PT shown in FIG. 2, which according to the invention can be contained in the dishwasher GS shown in FIG. 1. The essential facilities of the sump PT are shown in FIG. 2. These facilities include the circulating pump PU already mentioned in relation to FIG. 1, which is driven by an electric pump motor PM. The relevant facilities also include the water diverter WW already mentioned in relation to FIG. 1, which consists of a receiving container with an upper part OT and a lower part UT. In this receiving container of the water diverter WW, as will become clearer below, is a flat rotating disk with passage openings, it being possible to position said disk in different setting or rotation positions by means of an electric water diverter motor WM.

In the upper region of the sump PT shown in FIG. 2—said upper region facing the wet region NB mentioned in FIG. 1 of the dishwasher GS shown schematically in said figure—is a water collection opening AO in which washing water supplied to the dishwasher GS by the abovementioned water supply line or washing water from the washing liquor dispensed by the spray arms US, OS and the top spray DB according to FIG. 1 can be collected to be discharged from the abovementioned circulating pump PU under pressure by a supply pipe ZR shown in FIG. 2 to the water diverter WW. According to the setting of the rotating disk contained in it, the water diverter WW allows the washing water supplied to it by the supply pipe ZR to be distributed to the discharge pipes AR1, AR2 and AR3 shown in FIG. 2 in set combinations. The relevant combinations are set here by actuating the program buttons I to VI of the control facility ST shown in FIG. 1. The relevant combinations include the dispensing of the washing water supplied by the supply pipe ZR to one of the discharge pipes AR1, AR2, AR3 respectively, the simultaneous dispensing of said washing water to a number of the relevant discharge pipes and preventing the dispensing of the washing water.

Figure 3:
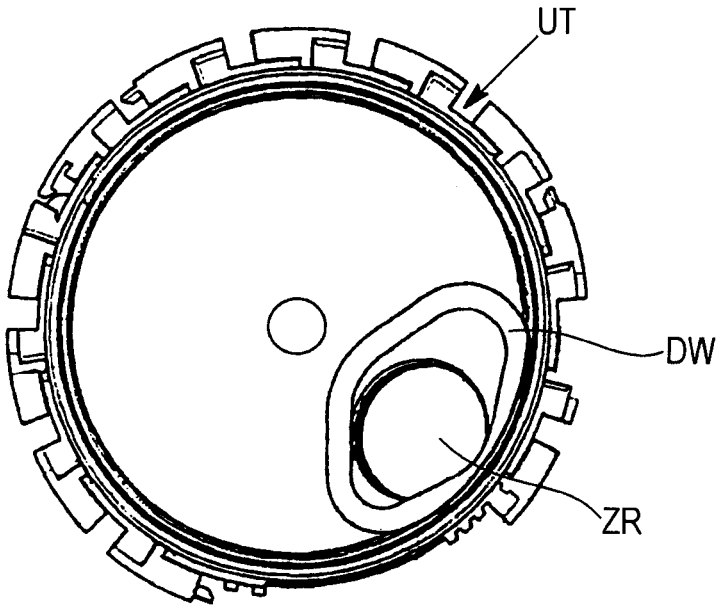
FIG. 3 shows a top view (not to scale) of a lower part of a receiving container of a water diverter connected to the sump apparatus shown in FIG. 2, being configured according to the invention.

FIG. 3 shows a top view (not to scale) of the lower part UT of the receiving container of the water diverter WW shown in FIG. 2. This lower part UT is connected directly to the supply pipe ZR according to FIG. 2. The outlet region of the supply pipe ZR is enclosed on the upper face of the lower part UT by an extension element in the form of an oval-shaped sealing bead DW, which is preferably made of a soft elastic plastic or rubber. The abovementioned flat rotating disk with passage openings, which can be seen clearly in FIGS. 4, 5 and 6, lies adjacent to the upper face of the sealing bead DW shown in FIG. 3 in a sealing manner, so that there is no or no appreciable water egress—or generally no fluid egress—between the sealing bead DW and the relevant rotating disk in any of its setting or rotation positions.

Figure 4:
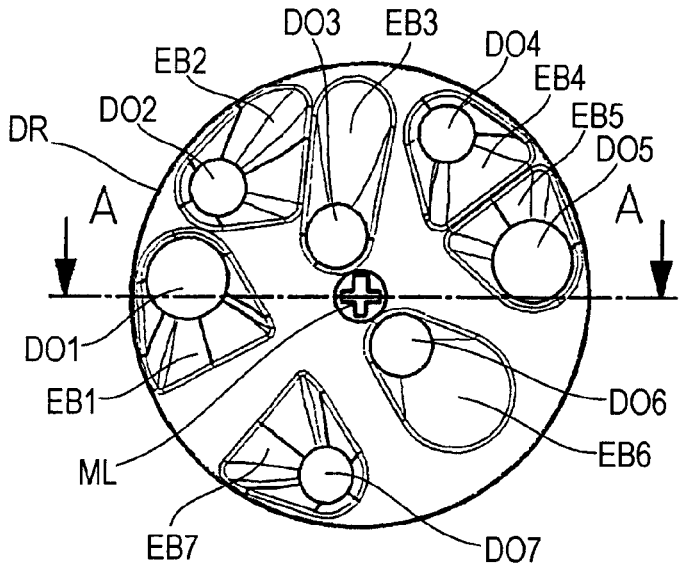
FIG. 4 shows a bottom view (not to scale) of a flat rotating disk contained in the receiving container of the water diverter shown in FIG. 2.

FIG. 4 shows a bottom view (not to scale) of the abovementioned rotating disk DR, which is contained in the water diverter WW and which can be rotated by the water diverter motor WM shown in the perspective view in FIG. 2. The rotating disk DR, which is preferably made of a strong material or a tough plastic, has a series of, in this instance round, passage openings DO1, DO2, DO3, DO4, DO5, DO6 and DO7, which are also configured to be of different sizes according to the different tasks of the washing liquor to be dispensed by them in each instance.

Each of the passage openings DO1, DO2, DO3, DO4, DO5, DO6 and DO7 has its own intake region EB1, EB2, EB3, EB4, EB5, RB6 and EB7. In the center of the rotating disk DR is a center hole ML, which can be used to hold the rotating disk DR in question on a drive shaft, which can be driven by the water diverter motor WM shown in FIG. 2. The relevant intake regions EB1 to EB7 are formed so that they interact with the sealing bead DW shown in FIG. 3 to allow the positioning of a respectively set combination of passage openings DO1 to DO7 for the passage of washing water or to block such passage of washing water, as will become clearer below. All the intake regions EB1 to EB7 here are provided with borders around them, which project from the lower face of the rotating disk. This separates the individual intake regions EB1 to EB7 distinctly from one another and thus allows them to lie respectively adjacent to the sealing bead DW of the lower part UT of the receiving container of the water diverter WW shown in FIG. 2 and be supplied with washing water from the supply pipe ZR.

Figure 5:
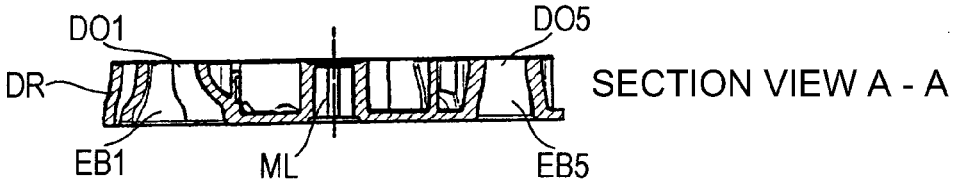
FIG. 5 shows a sectional view of the rotating disk along the section line A-A marked in FIG. 4.

The sectional view shown in FIG. 5, which corresponds to the section A-A according to FIG. 4, shows the rotating disk DR in more detail. It shows the passage openings DO1 and DO5 with their intake regions EB1 and EB5 and the center hole ML in greater detail. It can be seen that the intake regions EB1 and EB5 associated with the passage openings DO1, DO5 respectively are funnel-shaped. The thickness of the rotating disk DR is between 5 mm and 20 mm, preferably around 12.5 mm. The funnel-shaped configuration mentioned above produces a Venturi effect for the washing water supplied by the relevant passage openings DO1, DO5 respectively from their intake regions EB1 and EB5. The action of the relevant Venturi effect will be examined in more detail below.

Because the passage openings DO1 to DO7 with their associated intake regions EB1 to EB7 are aligned in such a manner in relation to the supply pipe ZR and the discharge pipes AR1, AR2, AR3 that the fluid flow directions into and out of the relevant passage openings DO1 to DO7 of the rotating disk DR run respectively in the axial direction of the rotating disk and therefore practically in a straight line from the supply pipe ZR to the discharge pipes AR1, AR2, AR3 without flow deflection, a fluid flow without appreciable pressure loss is also ensured in this region. The relevant pressure loss here is for example just 20 mbar, which is much lower than with the water diverters known to date.

Figure 6:
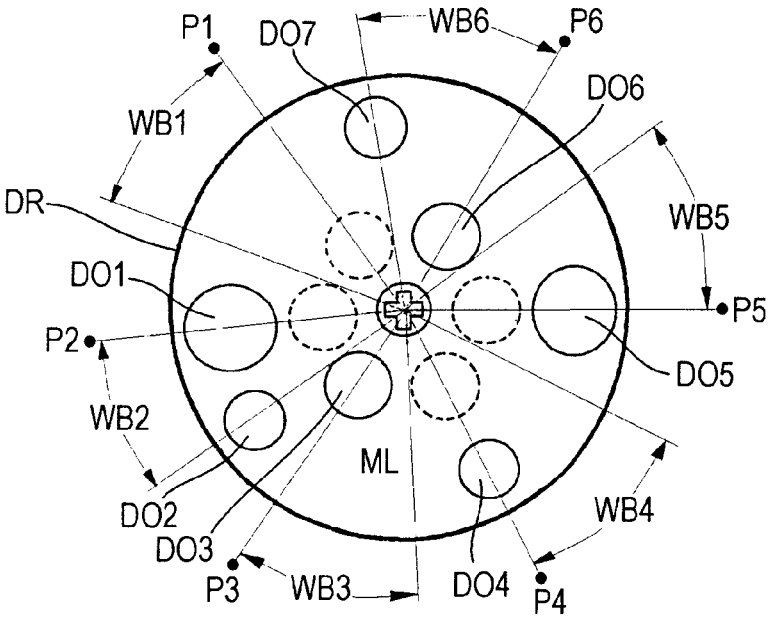
FIG. 6 shows a top view of the flat rotating disk shown in a bottom view in FIG. 4.

FIG. 6 shows the rotating disk DR shown from the bottom in FIG. 4 in a top view. The passage openings DO1 to DO7 and the center hole ML are shown here. The passage opening DO1 and the passage opening DO5 serve to dispense washing liquor to the discharge pipe AR1 shown in FIG. 2 and therefore to dispense it to the lower spray arm US according to FIG. 1. The passage openings DO2, DO3 and DO7 serve to dispense washing liquor to the discharge pipe AR2 according to FIG. 2 and therefore to dispense it to the upper spray arm OS according to FIG. 1 and the passage openings DO3 and DO6 serve to dispense washing liquor to the discharge pipe AR3 according to FIG. 2 and therefore to dispense it to the top spray DB according to FIG. 1. In FIG. 6 the positions of the passage openings DO3 and DI6 are shown with a broken line in a total of six different setting or rotation positions P1, P2, P3, P4, P5 and P6, in which the rotating disk DR can be set in 60° steps around the center hole ML by the water diverter motor WM in illustrated in FIG. 2. In these six different rotation or setting positions P1 to P6 the rotating disk DR has six different action regions WB1, WB2, WB3, WB4, WB5 and WB6, which generally extend respectively over an angle range between around 25° and 40°.

In the setting position P1 with the action region WB1 the supply pipe ZR according to FIG. 2 is not connected to any of the passage openings DO1 to DO7. In this instance the routing of washing liquor or water from the supply pipe ZR to the discharge pipes AR1, AR2, AR3 according to FIG. 2 is blocked. The dishwasher GS is therefore in the OFF state.

In the setting position P2 the passage openings DO1 and DO2 are connected between the supply pipe ZR according to FIG. 2 and the discharge openings AR1 and AR2 according to FIG. 2 within the action region WB2 associated therewith. In this setting or rotation position of the rotating disk DR washing liquor is supplied simultaneously to the lower spray arm US and the upper spray arm OS according to FIG. 1.

In the setting position P3 the rotating disk DR establishes a connection between the supply pipe ZR according to FIG. 2 and just the discharge pipe AR3 and therefore to the top spray DB according to FIG. 1 through the passage opening DO3 within the action region WB3, which corresponds in size to each of the other action regions.

In the setting position P4 a connection is established between the supply pipe ZR according to FIG. 2 and just the discharge pipe AR2 according to FIG. 2 and therefore only to the upper spray arm OS according to FIG. 1 within the action region WB4 associated therewith.

In the setting position P5 of the rotating disk DR a connection is only established between the supply pipe ZR according to FIG. 1 and the discharge pipe AR1 according to FIG. 2 and therefore only to the lower spray arm US according to FIG. 1 within the action region WB5.

In the setting position P6 of the rotating disk DR finally a simultaneous connection is established between the supply pipe ZR according to FIG. 2 and the discharge pipes AR2 and AR3 according to FIG. 2 and therefore to the upper spray arm OS and the top spray DB according to FIG. 1 within the action region WB6.

Figure 7:
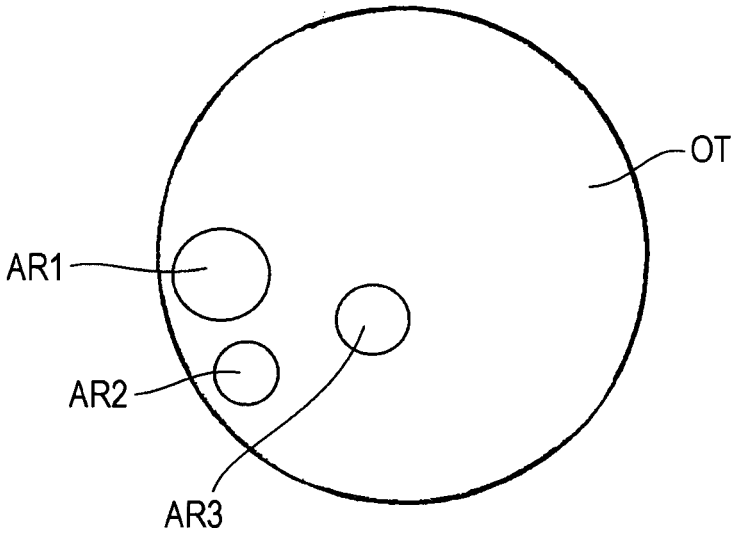
FIG. 7 shows a top view (not to scale) of the upper part of the receiving container of the water diverter shown in FIG. 2

FIG. 7 shows a schematic diagram (not to scale) of the upper part OT of the receiving container of the water diverter WW shown in FIG. 2 and consisting of the lower part UT already described with reference to FIG. 3 and the upper part OT. The three abovementioned discharge pipes AR1, AR2 and AR3 in their relative positions to one another are clearly visible in FIG. 7. These positions correspond to the passage openings DO1, DO2 and DO3 in relation to the diagram in FIG. 6. These positions of the discharge pipes AR1, AR2 and AR3 in relation to the passage openings DO1, DO2, DO3, DO4, DO5, DO6 and DO7 shown in FIGS. 4 and 6 mean that in the setting positions P2 to P6 described in conjunction with FIG. 6 washing liquor can be dispensed from the supply pipe ZR indicated in FIG. 2 to the abovementioned discharge pipes AR1, AR2 and AR3; no washing liquor is dispensed in the setting position P1.

Figure 8:
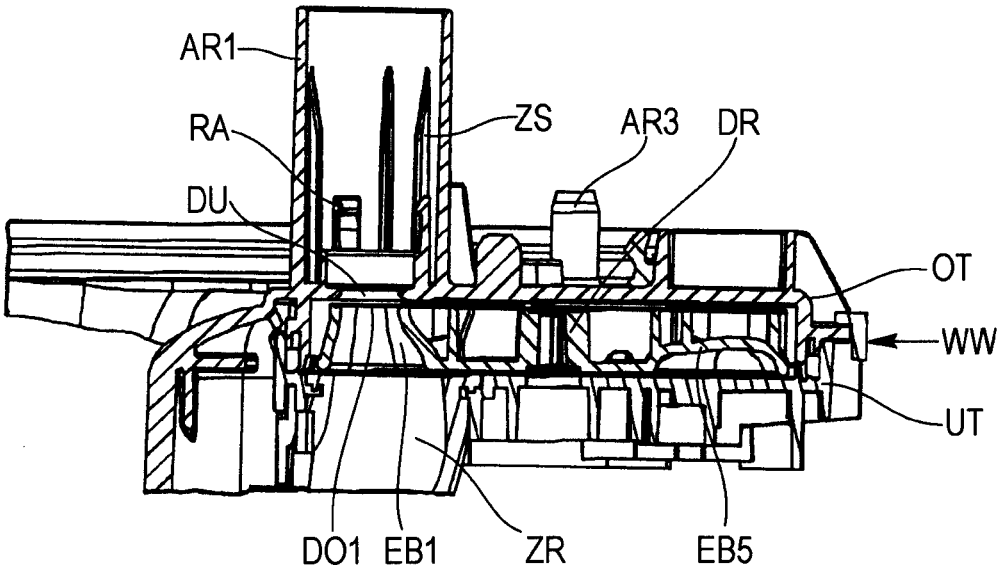
FIG. 8 shows a sectional diagram (not to scale) of the water diverter configured according to the invention and shown in FIG. 2, with the flat rotating disk disposed between the abovementioned lower part and the abovementioned upper part of the receiving container.

FIG. 8 shows a sectional diagram (not to scale) of a configured structure of the water diverter WW shown in FIG. 2 with the receiving container consisting of the upper part OT and the lower part UT for the rotating disk DR. As shown in FIG. 8, the rotating disk DR with its passage opening DO1 and its associated intake region EB1 is aligned between the supply pipe ZR and the discharge pipe AR1. Of the further passage opening DO5 only its associated intake region EB5 is shown in FIG. 8 and this does not in any case have a connection to a further discharge pipe. The discharge pipe AR3 shown in FIG. 8, which leads to the top spray DB shown in FIG. 1, does not have a connection to a passage opening of the rotating disk DR either.

The arrangement shown in FIG. 8 of the passage opening DO1 in conjunction with its associated intake region EB1 means that a Venturi effect is exercised on the washing water (moving downward in FIG. 8) supplied from the supply pipe ZR, with the result that the flow speed of washing liquor dispensed to the relevant passage opening DO1 experiences an increase in speed in the passage opening DO1, in other words in its narrowing region, compared with the flow speed at which the washing water is dispensed from the supply pipe ZR. This increase in speed is however associated according to Venturi's law with a reduction in the pressure of the washing liquor dispensed from the passage opening DO1 in the transition region in question from the passage opening DO1 into the discharge pipe AR1. This pressure reduction here is so significant that the pressure of the washing liquor dispensed through a passage opening DU formed in the abovementioned upper part OT to the discharge pipe AR1 or generally speaking the fluid pressure of the fluid flowing through the transition region between the outlet side of the passage opening DO1 and the inlet region into the discharge pipe AR1 is lower than the pressure in the region surrounding the relevant transition region. However atmospheric pressure of 1 bar generally prevails in the region surrounding the arrangement in question. Because the pressure of the washing liquor dispensed from the passage opening DO1 to the discharge pipe AR1 is lower in the transition region between the relevant passage opening and said discharge pipe AR1 than the atmospheric pressure in the relevant surrounding region—it can be 0.8 bar for example—it is thus ensured that in this transition region no water from the washing water dispensed by the supply pipe ZR can exit to the surrounding region.

Centering webs (three in total) are shown within the discharge pipe AR1 in FIG. 8, one of which is marked ZS. Some latching elements RA are also provided, serving together with the abovementioned centering webs ZS to hold a support element for the lower spray arm US of the dishwasher GS shown schematically in FIG. 1.

The sealing action utilizing the Venturi effect as described above does not only occur in the situation illustrated in FIG. 8. It also occurs in all the setting positions P2 to P6 of the rotating disk DR of the water diverter WW described with reference to FIGS. 4 to 6, even when washing liquor is dispensed simultaneously from a number of passage openings contained in the rotating disk DR.

Because the passage openings DO1 to DO7 with their associated intake regions EB1 to EB7 are aligned in such a manner in relation to the supply pipe ZR and the discharge pipes AR1, AR2, AR3 that the fluid flow directions into and out of the relevant passage openings DO1 to DO7 of the rotating disk DR run respectively in the axial direction of the rotating disk and therefore practically in a straight line from the supply pipe ZR to the discharge pipes AR1, AR2, AR3 without flow deflection, a fluid flow without pressure loss is also ensured in this region.

Finally it should also be noted that the present invention is not restricted to the use of water as the fluid to seal the transition region between a rotatable fluid distribution element, to which a fluid to be discharged to one or more fluid discharge lines can be supplied from a fluid supply line, and inlet regions of the relevant fluid discharge lines. Rather the present invention can be used for the corresponding sealing of transition regions in apparatuses in which fluids other than water, for example oil or gases, come to be used.

It should also be noted with regard to the passage openings DO1 to DO7 of the rotating disk DR that these can also all be configured as the same size and that the action regions WB1 to WB6 associated with the different rotation or setting positions P1 to P6 of the rotating disk DR can optionally be different sizes.

LIST OF REFERENCE CHARACTERS

AO Water collection opening
AR1, AR2, AR3 Water discharge path
DB Top spray
DI Sealing ring
DO1, DO2, DO3, DO4, DO5, Passage opening
DO6, DO7
DR Rotating disk
DU Passage opening
DW Extension element
EB1, EB2, EB3, EB4, EB5, Intake region
EB6, EB7
GS Dishwasher
I, II, III, IV, V, VI Program buttons
ML Center hole
NB Wet region
OK Upper rack
OS Upper spray device
OT Upper part
P1, P2, P3, P4, P5, P6 Setting or rotation position
PA Sump holder
PM Pump motor
PT Sump
PU Circulating pump
R1, R2, R3 Pipe
RA Latching element
ST Control facility
UK Lower rack
US Lower spray device
UT Lower part
WB1, WB2, WB3, WB4, WB5, Action region
WB6, WB7
WM Water diverter motor
WW Water diverter
ZR Water supply path
ZS Centering web

The invention claimed is:

1. A water-bearing domestic appliance, comprising:
a wash container; and
a water diverter, the water diverter comprising:
a receiving container having an upper portion and a lower portion, wherein the upper portion comprises one or more discharge pipes connected thereto and the lower portion comprising an extension element connected to a water supply path; and
an adjustable fluid distribution element comprising a rotating disk disposed between the upper portion and lower portion of the receiving container, wherein the rotating disk comprises passage openings, wherein one or more of the passage openings fluidly connect the water supply path to a respective water discharge path such that a water flow direction from the water supply path to the respective water discharge path is substantially a straight line in an axial direction of the rotating disk thereby reducing pressure loss of the water flow through the water diverter, wherein the water discharge path comprises the one or more discharge pipes supplying water to the wash container, wherein the extension element fluidly connects the water supply path with the rotating disk thus allowing one or more of the passage openings in the rotating disk to be supplied with water from the water supply path and thus to route the water to the water discharge path via the one or more discharge pipes with reduced pressure loss; and wherein the passage openings disposed on a side of the rotating disk facing the water supply path include intake regions extended in a funnel shape.

2. The water-bearing domestic appliance as claimed in claim 1, wherein the extension element lies adjacent to a peripheral region of the rotating disk and provided on the side of the passage openings facing the water supply path.

3. The water-bearing domestic appliance as claimed in claim 2, wherein the extension element includes an oval shape running in the peripheral region of the rotating disk.

4. The water-bearing domestic appliance as claimed in claim 1, wherein intake regions of the passage openings are formed such that a set number of the one or more discharge pipes are connected to the water supply path for a passage of water in different setting positions of the adjustable fluid distribution element.

5. The water-bearing domestic appliance as claimed in claim 1, wherein the water-bearing domestic appliance comprises a dishwasher.

6. The water-bearing domestic appliance as claimed in claim 1, wherein the water-bearing domestic appliance comprises a washing machine.

7. The water-bearing domestic appliance as claimed in claim 1, wherein the water diverter effects a pressure loss of about 20 mbar or less.

8. The water-bearing domestic appliance as claimed in claim 1, wherein the water supplied to the wash container comprises a washing liquor.

9. The water-bearing domestic appliance as claimed in claim 1, wherein the passage openings are configured to produce a Venturi effect.

10. The water-bearing domestic appliance as claimed in claim 9, wherein a pressure of water is lower as the water flows through a transition region between an outlet side of the passage openings and an inlet region of the water discharge path.

11. The water-bearing domestic appliance as claimed in claim 9, wherein the Venturi effect provides a sealing action.

12. The water-bearing domestic appliance as claimed in claim 1, wherein the adjustable fluid distribution element is configured to allow water supplied to it by the water supply path to be distributed to the one or more discharge pipes of the water discharge path in set combinations.

13. A water-bearing domestic appliance, comprising:
a wash container; and
a water diverter, comprising:
a receiving container having an upper portion and a lower portion, wherein the upper portion comprises one or more discharge pipes connected thereto and the lower portion comprises an extension element connected to a water supply path; and
an adjustable fluid distribution element comprising a rotating disk disposed between the upper portion and lower portion of the receiving container, wherein the rotating disk comprises passage openings, wherein one or more of the passage openings fluidly connect the water supply path to a water discharge path such that a water flow direction from the water supply path to the water discharge path is substantially a straight line in an axial direction of the rotating disk thereby reducing pressure loss of the water flow through the water diverter, wherein the water discharge path comprises the one or more discharge pipes supplying water to the wash container, and wherein the passage openings disposed on a side of the rotating disk facing the water supply path include intake regions extended in a funnel shape producing a Venturi effect, and further wherein the extension element fluidly connects the water supply path with the rotating disk thus allowing the passage openings in the rotating disk to be supplied with water from the water supply path and thus to route the water to the water discharge path via the one or more discharge pipes with reduced pressure loss.

14. A water diverter, comprising:

a receiving container having an upper portion and a lower portion, wherein the upper portion comprises one or more discharge pipes connected thereto and the lower portion comprises an extension element connected to a water supply path; and an adjustable fluid distribution element comprising a rotating disk disposed between the upper portion and lower portion of the receiving container, wherein the rotating disk comprises passage openings, wherein one or more of the passage openings fluidly connect the water supply path to a water discharge path such that a water flow direction from the water supply path to the water discharge path is substantially a straight line in an axial direction of the rotating disk thereby reducing pressure loss of the water flow through the water diverter, wherein the water discharge path comprises the one or more discharge pipes, wherein the extension element fluidly connects the water supply path with the rotating disk thus allowing the passage openings in the rotating disk to be supplied with water from the water supply path and thus to route the water to the water discharge path via the one or more discharge pipes with reduced pressure loss; and wherein the passage openings disposed on a side of the rotating disk facing the water supply path include intake regions extended in a funnel shape.

* * * * *